US010016799B2

(12) United States Patent
Carvalho et al.

(10) Patent No.: US 10,016,799 B2
(45) Date of Patent: Jul. 10, 2018

(54) DYNAMIC SHIFTING OF REDUCTION (DSR) TO CONTROL TEMPERATURE IN TANDEM ROLLING MILLS

(71) Applicant: Novelis do Brasil Ltda., Sao Paulo (BR)

(72) Inventors: Francisco Carvalho, Guaratingueta (BR); Eduardo Minniti, Pindamonhangaba (BR); Carlos Eboli, Kennesaw, GA (US)

(73) Assignee: NOVELIS DO BRASIL LTDA, Sao Paulo (BR)

( * ) Notice: Subject to any disclaimer, the term of this patent is extended or adjusted under 35 U.S.C. 154(b) by 823 days.

(21) Appl. No.: 14/577,214

(22) Filed: Dec. 19, 2014

(65) Prior Publication Data

US 2015/0174629 A1 Jun. 25, 2015

Related U.S. Application Data

(60) Provisional application No. 61/919,048, filed on Dec. 20, 2013.

(51) Int. Cl.

| | |
|---|---|
| ***B21B 37/48*** | (2006.01) |
| ***B21B 37/74*** | (2006.01) |
| ***B21B 1/24*** | (2006.01) |
| ***B21B 31/02*** | (2006.01) |
| ***B21B 31/18*** | (2006.01) |
| ***B21B 45/02*** | (2006.01) |
| *B21B 37/62* | (2006.01) |
| *B21B 38/00* | (2006.01) |
| *B21B 38/04* | (2006.01) |

(52) U.S. Cl.

CPC ..... *B21B 37/74* (2013.01); *B21B 1/24* (2013.01); *B21B 31/02* (2013.01); *B21B 31/18* (2013.01);

(Continued)

(58) Field of Classification Search

CPC ..... B21B 37/74; B21B 1/24; B21B 31/02; B21B 31/18; B21B 45/0203; B21B 37/62;

(Continued)

(56) References Cited

U.S. PATENT DOCUMENTS 3,940,598 A 2/1976 Sekiguchi
6,269,668 B1 * 8/2001 Shiraishi ..... B21B 37/54 72/11.4

(Continued)

FOREIGN PATENT DOCUMENTS

CN 1070391 C 9/2001
CN 102941232 A 2/2013

(Continued)

OTHER PUBLICATIONS

PCT/IB2014/067176, "International Search Report and Written Opinion", dated Mar. 11, 2015, 11 pages.

(Continued)

*Primary Examiner* — David B Jones
(74) *Attorney, Agent, or Firm* — Kilpatrick Townsend & Stockton LLP

(57) ABSTRACT

A closed loop temperature control system for use in tandem rolling mills. The closed loop temperature control system uses dynamic information about the temperature of the material moving through the mill to adjust the work rolls to adjust the amount of thickness reduction between the stands to control the temperature of the material as it moves through the mill. In one embodiment, the control system is configured to eliminate or reduce temperature differences across the length of the material as the material moves through acceleration, steady state, and deceleration stages of the rolling process.

20 Claims, 7 Drawing Sheets

(52) U.S. Cl.
CPC ..... *B21B 45/0203* (2013.01); *B21B 37/62* (2013.01); *B21B 38/006* (2013.01); *B21B 38/04* (2013.01); *B21B 2261/04* (2013.01); *B21B 2261/20* (2013.01); *B21B 2265/14* (2013.01)

(58) Field of Classification Search
CPC ... B21B 38/006; B21B 38/04; B21B 2261/04; B21B 2261/20; B21B 2265/14; B21B 37/54; B21B 37/58
USPC ..... 72/14.6
See application file for complete search history.

(56) References Cited

U.S. PATENT DOCUMENTS

| | | | | |
|---|---|---|---|---|
| 9,547,290 | B2 * | 1/2017 | Dagner | B21B 37/58 |
| 9,751,165 | B2 * | 9/2017 | Dagner | B21B 37/58 |

FOREIGN PATENT DOCUMENTS

| | | | |
|---|---|---|---|
| EP | 2662158 | A1 | 11/2013 |
| EP | 2500114 | B1 | 10/2015 |
| JP | 2013220471 | A | 10/2013 |
| KR | 10-0226299 | B1 | 10/1999 |

OTHER PUBLICATIONS

Korean Patent Application No. 10-2016-7019751, Notice of Preliminary Rejection dated Feb. 10, 2017, English translation, 4 pages.
Canadian Patent Application No. 2,934,185, Office Action dated May 11, 2017, 4 pages.
Korean Patent Application No. 10-2016-7019751, Office Action dated Sep. 1, 2017, 5 pages.
Chinese Pat. Appl. No. 201480069907.1, Office Action dated Jun. 2, 2017, 18 pages.

* cited by examiner

DYNAMIC SHIFTING OF REDUCTION (DSR) TO CONTROL TEMPERATURE IN TANDEM ROLLING MILLS

CROSS REFERENCE TO RELATED APPLICATION

The present application claims the benefit of U.S. Provisional Patent Application No. 61/919,048 filed Dec. 20, 2013, entitled "DYNAMIC SHIFTING OF REDUCTION (DSR) TO CONTROL TEMPERATURE IN TANDEM ROLLING MILLS," which is hereby incorporated by reference in its entirety.

TECHNICAL FIELD

The present disclosure relates to tandem rolling mills generally and more specifically to providing a closed loop temperature control system for use with tandem rolling mills.

BACKGROUND

Rolling is a metal forming process in which stock sheets or strips are passed through at least one pair of rolls. Tandem rolling mills are configured so the rolling is performed in one pass through more than one pair of rolls instead of multiple passes through one pair of rolls. A tandem rolling mill includes at least two stands, each stand having at least one work roll pair that rolls the material to reduce the thickness of the material. Specifically, the material is rolled between the work roll pair so that it moves from a thicker gauge to a thinner gauge. The interaction between the work rolls and the material is sometimes referred to as the roll bite. The stands are placed in sequence such that the reductions are done successively. Tandem mills can be either hot or cold rolling mill types.

Some tandem rolling mills include backup rolls that provide rigid support to the work rolls and therefore allow the diameter of the work rolls to be reduced. Tandem rolling mills have a variety of configurations and can be two-high, three-high, four-high, six-high and so forth. A two-high roll may have two work rolls, each located on opposite sides of a strip of metal. A four-high roll may have four rolls, including two work rolls located on opposite sides of a strip of metal, and two backup rolls, each located on opposite sides of a work roll from the strip of metal.

After the stock sheets or strips pass through the tandem rolling mill, the final product can be either a coil of metal or a slab of metal, depending on the end use of the material. After undergoing the rolling process, the material generally has a temperature that is greater than room temperature due to heat generated during the rolling process, unless the material is exposed to a cooling process after the roll bite. The exit temperature of the material is a variable that must be carefully monitored and controlled, as the exit temperature of the material directly affects the material's mechanical properties.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Aspects of the present disclosure relate to a closed loop temperature control system for use in tandem rolling mills. The closed loop temperature control system uses dynamic information about the temperature of the material moving through the mill to adjust the work rolls to adjust the amount of thickness reduction between rolling stands to control the temperature of the material as it moves through the mill. In one embodiment, the control system is configured to eliminate or reduce temperature differences across the length of the material as the material moves through acceleration, steady state, and deceleration stages of the rolling process.

In some embodiments, the control system includes one or more sensors that continuously collect data from the material as it is rolled through the mill and that provide the data to one or more controllers that contain programs with logic to command one more actuators that adjust each stand to position the work rolls so they will perform the desired reduction in thickness of the material.

BRIEF DESCRIPTION OF THE DRAWINGS

Illustrative embodiments of the present disclosure are described in detail below with reference to the following drawing figures.

DETAILED DESCRIPTION

Figure 1:
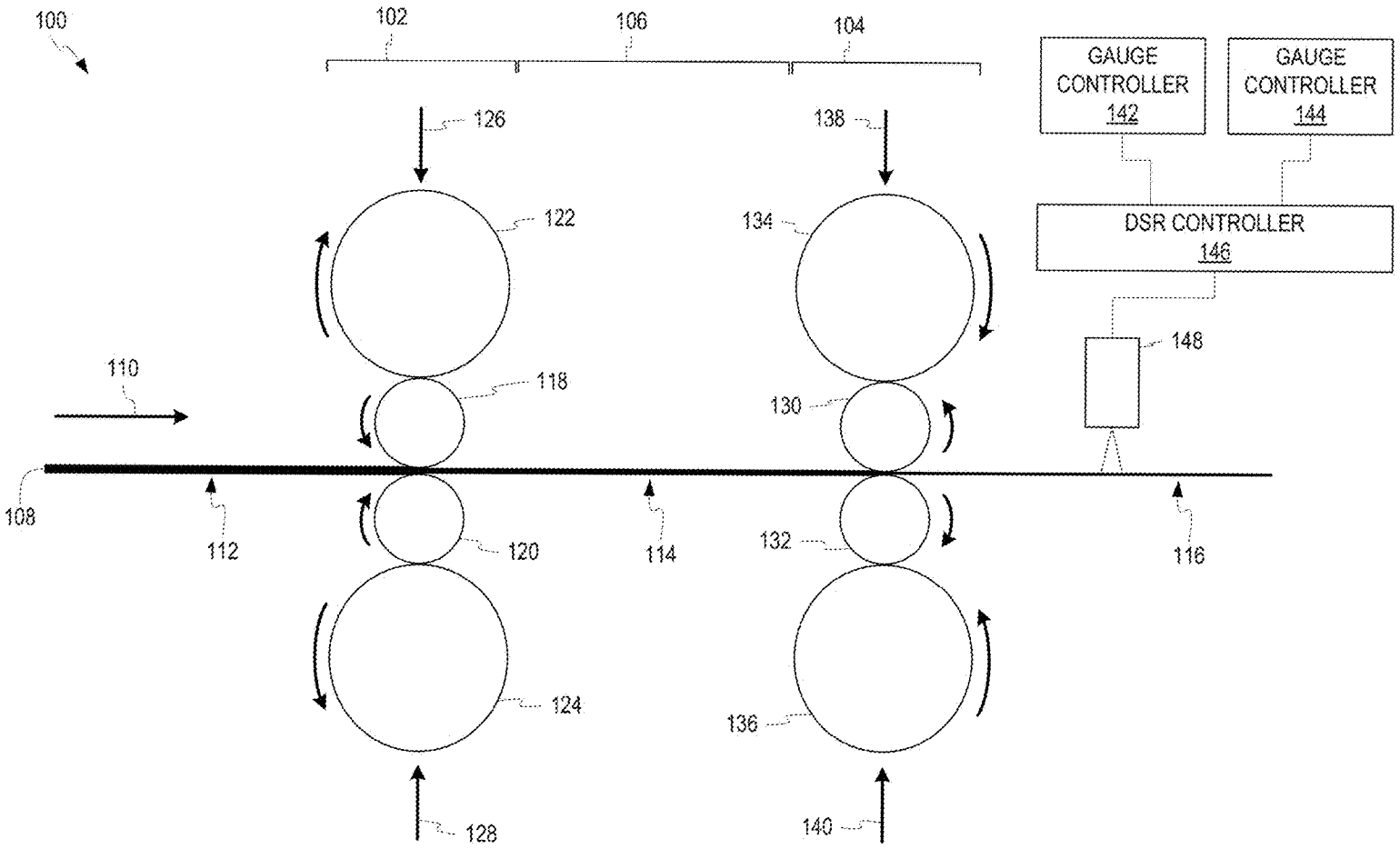
FIG. 1 is a schematic side view of a four-high, two-stand tandem rolling mill according to certain aspects of the present disclosure.

Certain aspects and features of the present disclosure relate to a temperature control system for use in tandem rolling mill operations. The control system monitors the temperature of the material moving through the mill and provides for a dynamic shifting of reduction (DSR) to control the temperature of the material. In particular, the system uses the capacity of the rolling process to generate more or less heat in the strip in each stand by adjusting the amount of thickness reduction of the strip. By dynamically shifting the amount of thickness reduction between stands of a multi-stand mill, the heat generated during the roll bite can be adjusted to control the temperature of the material as it moves through the mill. In particular, the temperature of the material can be controlled throughout the acceleration, steady state, and deceleration stages so that the temperature of the material is more consistent across the length of the material.

In an example, a method of using the disclosed temperature control system, the inter-stand thickness (the thickness of the material between stands) is set to an initial value based on the exit thickness of the material. The mill is then powered on. As the mill increases speed from zero to top speed, the motors heat up and in turn heat up the work rolls and the material. The one or more sensors of the control system obtain the temperature of the material (in some embodiments, the temperature of the material as it exits the mill) and send that information to one or more controllers. The one or more controllers process that data and make a determination about the temperature of the material and how that temperature compares to the desired exit temperature. If the temperature of the material is determined to be low, for example, if the work rolls and the material are still heating up during the acceleration stage of the process, the one or more controllers can increase the inter-stand thickness set point, which requires a higher reduction at the second stand, so that more heat is generated at the second stand and the exit temperature of the material is increased. This in turn generates more heat and achieves the target temperature for the material faster. The acceleration of the mill to its maximum speed is referred to as the acceleration transient of the material.

After a portion of the material has reached the target temperature, the material continues to heat until it reaches the maximum limit for the temperature, which is preset. The control system can then be programmed to dictate for how long the material will stay at the maximum limit temperature (e.g., to build additional heat to this region that had a lack of temperature due to the acceleration transient at the beginning of the process). After this time has passed, the control system decreases the inter-stand thickness set point, which necessitates less thickness reduction at the second stand, thus decreasing the amount of heat generated at the second stand and decreasing the exit temperature of the material until it enters the control limit again. When the mill reaches its maximum operating speed, it is referred to as the steady state region of the material.

Once the material enters the control limits of temperature, the one or more sensors continue to send data to the one or more controllers, which process the data and increase the thickness reduction at the second stand every time the sensors detect a drop in exit temperature and decrease the thickness reduction of the second stand every time the sensors detect an increase in exit temperature of the material. In this way, the exit temperature of the material can be controlled so that it remains uniform.

If desired, additional cooling media can be added by a heat extraction media system to help decrease the temperature of the material. Examples of cooling media can include cooling fluids such as air, water, oil, or other suitable fluids. Examples of a heat extraction media system can include a fluid pumping system or other suitable system for delivering cooling media. When the mill starts to slow down to finish the material production, the additional cooling can be turned off, increasing the temperature during this deceleration stage to compensate for the heat exchange after the coil is released from the mandrel and is subjected to cooling at room temperature. This is referred to as the deceleration transient of the material.

A material produced using the techniques described herein can have a more consistent yield strength across the length of the material (e.g., a coil of material).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a schematic side view of a four-high, two-stand tandem rolling mill 100 according to certain aspects of the present disclosure. The mill 100 includes a first stand 102 and a second stand 104 separated by an inter-stand space 106. A strip 108 passes through the first stand 102, inter-stand space 106, and second stand 104 in direction 110. The strip 108 can be a metal strip, such as an aluminum strip. As the strip 108 passes through the first stand 102, the first stand 102 rolls the strip 108 to a smaller thickness. As the strip 108 passes through the second stand 104, the second stand 104 rolls the strip 108 to an even smaller thickness. The pre-roll portion 112 is the portion of the strip 108 that has not yet passed through the first stand 102. The inter-roll portion 114 is the portion of the strip 108 that has passed through the first stand 102, but not yet passed through the second stand 104. The post-roll portion 116 is the portion of the strip 108 that has passed through both the first stand 102 and the second stand 104. The pre-roll portion 112 is thicker than the inter-roll portion 114, which is thicker than the post-roll portion 116.

The first stand 102 of a four-high stand includes opposing work rolls 118, 120 through which the strip 108 passes. Force 126, 128 is applied to respective work rolls 118, 120, in a direction towards the strip 108, by backup rolls 122, 124, respectively. Force 126, 128 can be controlled by gauge controller 142. Force 138, 140 is applied to respective work rolls 130, 132, in a direction towards the strip 108, by backup rolls 134, 136, respectively. Force 138, 140 can be controlled by gauge controller 144. The backup rolls provide rigid support to the work rolls. In alternative embodiments, force is applied directly to a work roll, rather than through a backup roll. In alternative embodiments, other numbers of rolls, such as work rolls and/or backup rolls, can be used.

An increase of force 126, 128 applied in the first stand 102 results in a further decrease of thickness in the inter-roll portion 114 of the strip 108, as well as a temperature increase in the inter-roll portion 114 of the strip 108. An increase of force 138, 140 applied in the second stand 104 results in a further decrease of thickness in the post-roll portion 116 of the strip 108, as well as a temperature increase in the post-roll portion 116 of the strip 108.

A temperature sensor 148 is positioned to measure the temperature of the post-roll portion 116 of the strip 108. The temperature sensor 148 can be positioned adjacent the strip 108. The temperature sensor 148 can be a non-contact sensor, such as an infrared temperature sensor, or any other type of sensor.

Gauge controllers 142, 144 can be controlled by the dynamic shifting of reduction (DSR) controller 146. The DSR controller 146 is coupled to the temperature sensor 148. The DSR controller 146 can use the sensed temperature of the post-roll portion 116 of the strip 108 to adjust the amount of force 126, 128 applied in the first stand 102 and/or the amount of force 138, 140 applied in the second stand 104. The temperature sensor 148 can continuously collect temperature data from the strip 108 as it is rolled through the mill. In an embodiment, at least one temperature sensor 148 measures the temperature of the strip 108 after it exits the last stand. The temperature sensor 148 communicates the sensed temperature data to one or more controllers, such as the DSR controller 146, which contain the program logic for commanding one or more actuators (e.g., via gauge controllers 142, 144). The one or more controllers may be any suitable controller such as but not limited to TDC multiprocessor control systems or programmable logic controllers offered by Siemens.

In alternative embodiments, more than two stands can be used. In alternative embodiments, any number of sensors can be used, such as multiple sensors adjacent the post-roll portion 116 or sensors in the inter-stand space 106 adjacent the inter-roll portion 114.

Figure 2:
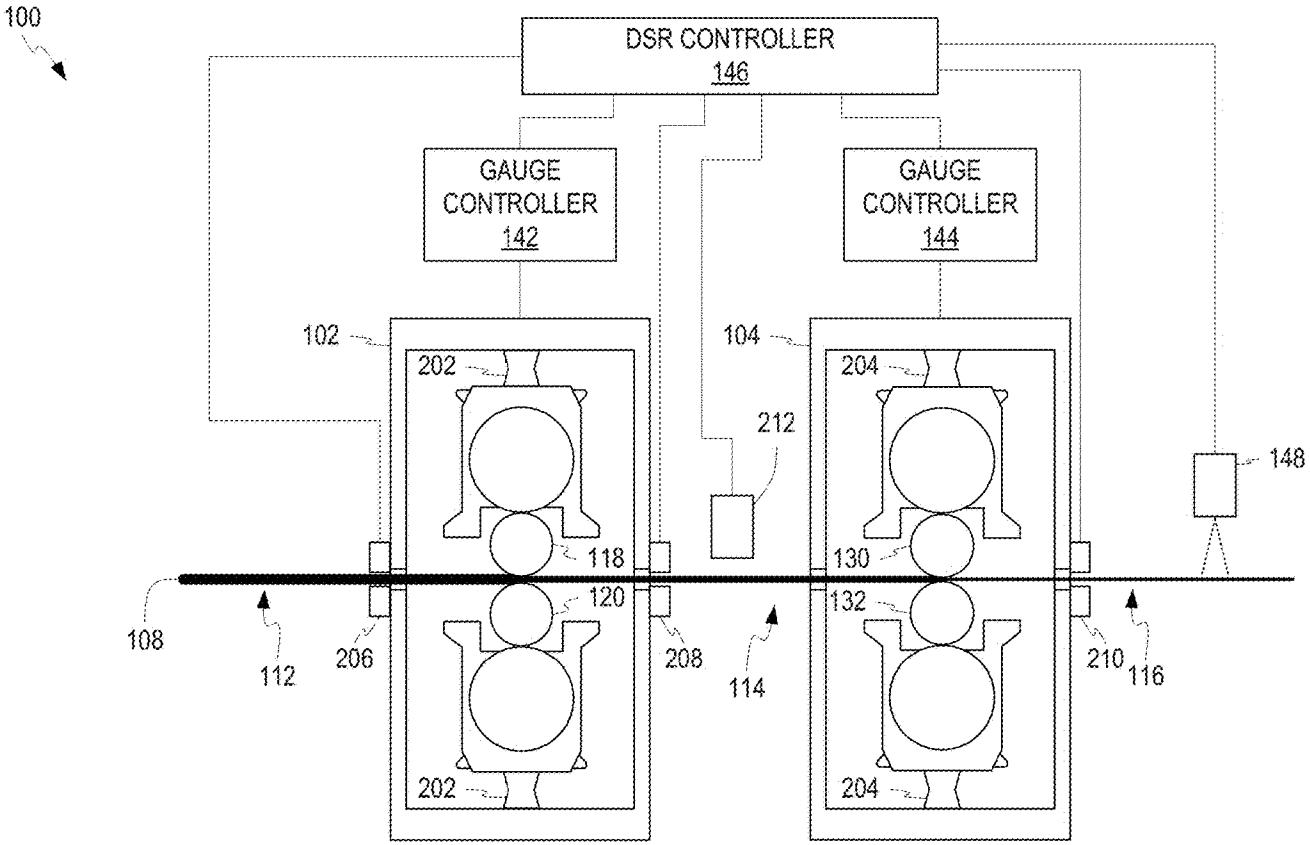
FIG. 2 is a schematic side view of the four-high, two-stand tandem rolling mill of FIG. 1 according to certain aspects of the present disclosure.

FIG. 2 is a schematic side view of the four-high, two-stand tandem rolling mill 100 of FIG. 1 according to certain aspects of the present disclosure. As described above, the DSR controller 146 can provide commands to one or more actuators 202, 204, such as through gauge controllers 142, 144.

The system can include one or more actuators for each stand, where each of the one or more actuators is configured to adjust the positioning of the work rolls relative to one another to generate the proper amount of rolling load to reduce the thickness of the material at that stand. As illustrated in the embodiment of FIG. 2, the first stand 102 can include actuators 202 that apply force to the work rolls 118, 120. The second stand 104 can include actuators 204 that apply force to the work rolls 130, 132. Any suitable actuator may be used to adjust the work rolls, including but not limited to hydraulic gap cylinders, so that the work rolls perform the desired reduction in thickness of the material as directed by the one or more controllers. In one embodiment, a high pressure hydraulic system feeds the cylinders to position the rolls to the correct gap to achieve the desired exit thickness.

The temperature of the material rolled through each stand in the mill depends on several variables. One of these variables is the thickness reduction of the material. In particular, electrical energy that powers the motor drives that cause the work rolls to spin at a controlled speed is converted to kinetic energy in the motor drives where the material is passing through the work rolls. Electric energy is also converted to kinetic energy in motor drives that drive the hydraulic pumps that pressurize the hydraulic gap cylinders to push the rolls against the material to generate the proper amount of rolling load to reduce the thickness of the material (e.g., the strip 108) to the desired level. A part of the energy spent to change the dimensional thickness of the material is converted to thermal energy due to the metal forming process, which in some cases, depending on the temperature of the material, heats the rolls and the material with thermal energy generated during the rolling process. If the material is pre-heated prior to rolling, however, the material may cool if the thermal energy lost by the material exceeds that gained from the thermal energy generated during the rolling process. Therefore, the thickness and thermal energy can be different between any of the pre-roll portion 112, the inter-roll portion 114, and the post-roll portion 116.

As discussed above, the disclosed control system controls the temperature along the length of the material by adjusting the reduction of the thickness of the material (e.g., by applying more or less force through actuators 202, 204). As also discussed, the thickness of the material after the material has moved through the system is an important output variable that must be tightly controlled. The thickness of the material after each pass through a stand can be controlled by the closed loop control system disclosed herein to ultimately achieve the target exit thickness of the material. Thickness sensors 206, 208, 210 can be placed adjacent the pre-roll portion 112, the inter-roll portion 114, or the post-roll portion 116, respectively, of the strip 108. The thickness sensors 206, 208, 210 can be coupled to the DSR controller 146.

In an embodiment, set points for the material thickness after a pass through each stand in the tandem roll mill can be defined, and the initial thickness reductions for each stand can be determined based on the set points for the material thickness. The inter-stand thickness set point refers to the target thickness of the material between two stands (e.g., the thickness of the inter-roll portion 114 of the strip 108 after it has passed through a first stand 102 but before it passes through the second stand 104). The DSR controller 146 can define an offset for all inter-stand thickness set points. By altering the target set point for the inter-stand thickness, the reduction of material to be performed at the first stand 102 is also changed, which generates more heat if the reduction is raised or less heat if the reduction is lowered. In this way, it is possible to control the exit temperature of the material by varying the thickness reduction across the stands. By controlling the exit temperature of the material, the material will have more consistent mechanical properties along its length.

In some embodiments, a heat extraction media system 212 is present. The heat extraction media system 212 can be located between the first stand 102 and the second stand 104 to extract heat from the strip 108, or can be located elsewhere. The heat extraction media system 212 can be coupled to the DSR controller 146 and can be controlled by the DSR controller 146. The heat extraction media system 212 can deliver cooling media to the strip 108, such as delivery of a cooling fluid like air, water, or oil to the strip 108 to extract heat from the strip 108. In some embodiments, the heat extraction media system 212 can include an air knife, a physical knife, or any other suitable device for removing the cooling media from the strip 108 prior to the strip 108 entering the second stand 104.

Figure 3:
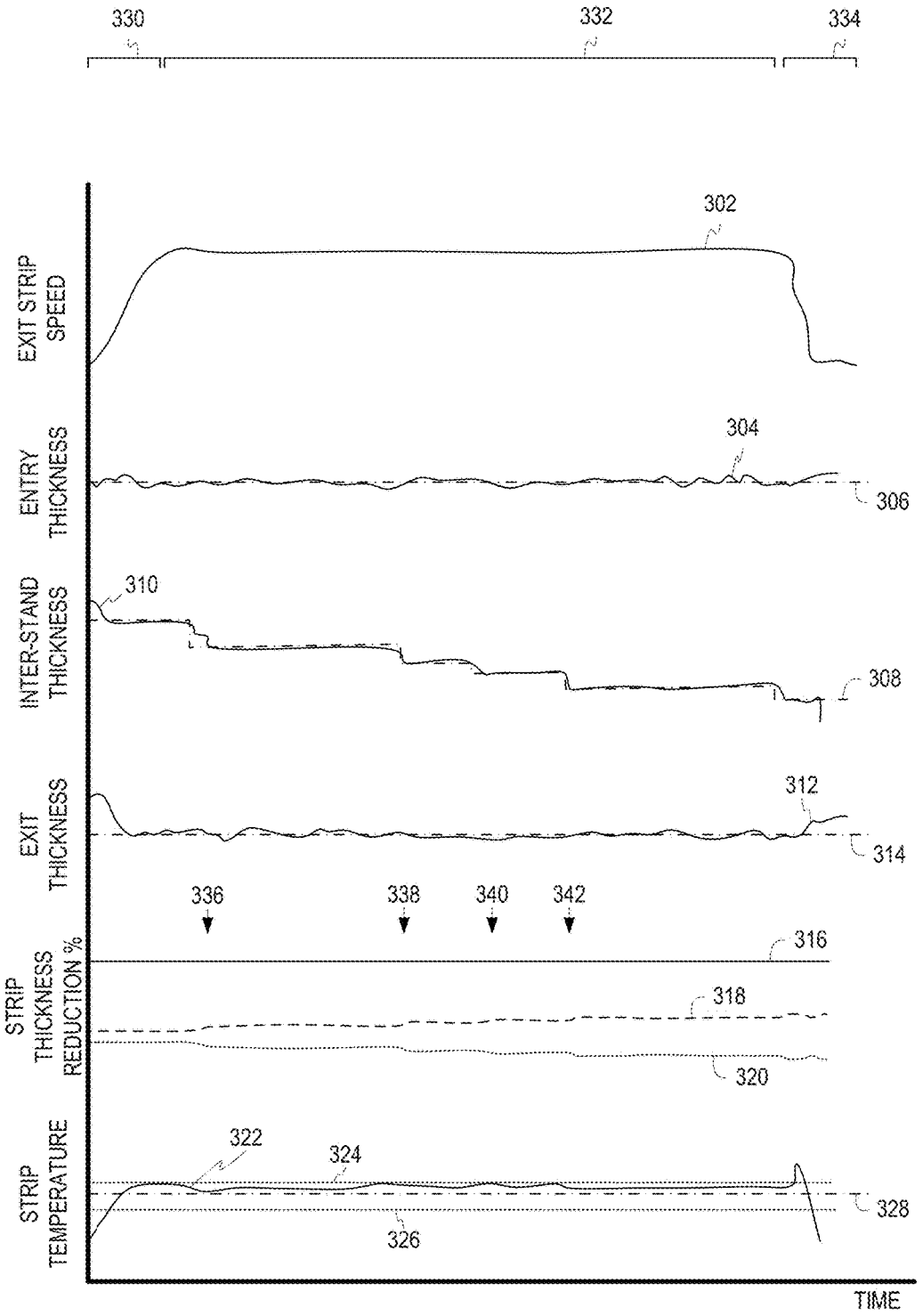
FIG. 3 is a set of graphs depicting various characteristics of a metal strip being rolled through a two stand mill, such as mill of FIG. 1, according to certain aspects of the present disclosure.

FIG. 3 is a set of graphs depicting various characteristics of a metal strip being rolled through a two stand mill, such as mill 100 of FIG. 1, according to certain aspects of the present disclosure. As explained above, the mill 100 can include three thickness measuring gauges (e.g., sensors 206, 208, 210), to measure the thickness of the material (e.g., strip 108). The mill 100 also includes a control system (e.g., DSR controller 146) having a temperature sensor 148 and an optional heat extraction media system 212 located between the first stand 102 and the second stand 104. The graphs depict the characteristics of the metal strip being rolled during an acceleration transient 330, a steady-state phase 332, and a deceleration transient 334.

In an "Exit Strip Speed" graph, the speed 302 of the strip 108 exiting the second stand 104 is shown. The speed 302 can increase to a set speed (e.g., target speed) and continue at a relatively constant speed. The speed 302 can increase during the acceleration transient 330 and decrease during the deceleration transient 334.

In an "Entry Thickness" graph, the thickness 304 of the pre-roll portion 112 of the strip 108 is shown. The thickness 304 can be measured by sensor 206. The target thickness 306 is the expected thickness of the metal strip, while the thickness 304 is the actual measured thickness of the metal strip.

In an "Inter-Stand Thickness" graph, the thickness 310 of the inter-roll portion 114 of the strip 108 is shown. The thickness 310 of the inter-roll portion 114 is the thickness of the strip 108 after it has been rolled by the first stand 102. The thickness 310 shows several instances where the first stand 102 has been adjusted to change how much the first stand 102 reduces the thickness of the strip 108. The inter-stand target thickness 308 can be a target thickness (e.g., a set point) for the inter-stand thickness 310. The inter-stand thickness 310 can be used to determine how much the second stand 104 should roll the strip 108 to achieve the desired final thickness of the strip 108. For example, more reduction achieved with the first stand will result in a smaller inter-stand thickness 310, which would require less reduction from the second stand. The inter-stand thickness 310 can be measured by sensor 208. The inter-stand target thickness 308 can be set to a new set point based on any variable, such as the strip temperature 322.

In an "Exit Thickness" graph, the thickness 312 of the post-roll portion 116 of the strip 108 is shown. The thickness 312 of the post-roll portion 116 is the thickness of the strip 108 after it has been rolled by both the first stand 102 and the second stand 104. The thickness 312 shows a relatively constant thickness. The target thickness 314 can be a set point for the exit thickness 312. The exit target thickness 314 can be the desired final thickness of the strip 108. The exit thickness 312 can take a little time to reach the target thickness 314 during the acceleration transient 330. The exit thickness 312 can deviate from the target thickness 314 during the deceleration transient 334. The exit thickness 312 can be measured by sensor 210.

In a "Strip Thickness Reduction %" graph, a total thickness reduction percentage 316 can be shown, along with a thickness reduction percentage 318 from the first stand 102 and a thickness reduction percentage 320 from the second stand 104. As the first stand 102 reduces the strip 108 more, the second stand 104 reduces the strip 108 less. As seen in FIG. 3, the first stand 102 continues to reduce the strip 108 more (e.g., the inter-stand thickness 310 reduces) over time, as seen by the increased thickness reduction percentage 318 from the first stand 102.

In other words, at each of moments 336, 338, 340, and 342, the reduction percentage shifts from the second stand to the first stand, resulting in less thickness reduction in the second stand. This shift can be seen by the thickness reduction percentage 318 of the first stand increasing at each of moments 336, 338, 340, 342 and the thickness reduction percentage 320 of the second stand decreasing at each of moments 336, 338, 340, 342.

In a "Strip Temperature" graph, the temperature 322 of the strip is shown. The strip temperature 322 can be seen as staying within a range of a maximum temperature 324 and a minimum temperature 326. The strip temperature 322 can also be set by a target temperature 328. The strip temperature 322 can slowly rise during the acceleration transient 330 and decrease during the deceleration transient 334. The strip temperature 322 can be measured by temperature sensor 148.

Due to DSR control, the strip temperature 322 can quickly reach the target temperature 328 during the acceleration transient 330 (e.g., by shifting more thickness reduction to the second stand). At each of moments 336, 338, 340, 342, the DSR controller can shift thickness reduction from the second stand to the first stand in response to the strip temperature 322 reaching the maximum temperature 324 immediately prior to each of moments 336, 338, 340, 342.

As seen in FIG. 3, each time the strip temperature 322 was near to exceeding the maximum temperature 324, the DSR controller 146 adjusted the gauge controllers 142, 144 in order to adjust the thickness reduction percentages 318, 320 of the first stand 102 and second stand 104, respectively, which caused the strip temperature 322 to approach the target temperature 328.

In most applications, the exit thickness 312 of the material (e.g., the thickness of the material after it passes through the last stand) is defined by a customer or other third party and is therefore a fixed variable that does not change during the rolling process. Similarly, the entry thickness 304 of the material (e.g., the thickness of the material as it enters the first stand 102) is already determined and does not change.

Figure 4:
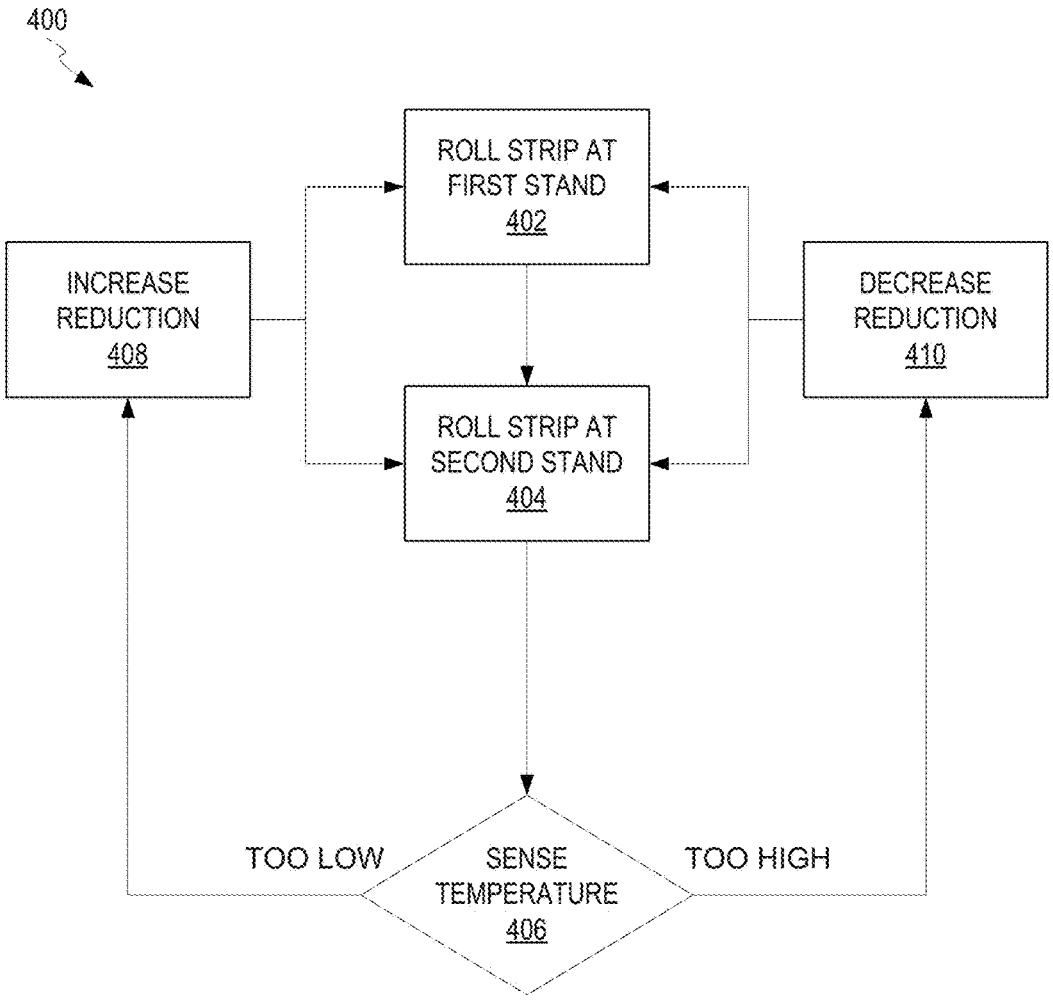
FIG. 4 is a method for rolling a strip according to certain aspects of the present disclosure.

FIG. 4 is a method 400 for rolling a strip 108 according to certain aspects of the present disclosure. The strip is rolled at the first stand at block 402 and then rolled at the second stand at block 404. At block 406, the temperature is sensed. If the temperature that is sensed is too low, the DSR controller increases the reduction at block 408. Reduction can be increased at block 408 by increasing the reduction of the first stand or second stand or both. In an example, reduction can be increased at block 408 by increasing the reduction of the second stand during rolling at block 404. If the temperature that is sensed is too high, the DSR controller decreases the reduction at block 410. Reduction can be decreased at block 410 by decreasing the reduction of the first stand or second stand or both. In an example, reduction can be decreased at block 410 by decreasing the reduction of the second stand during rolling at block 404. Any change in reduction to the second stand can be accommodated by changing the reduction in the first stand by an approximate opposite amount. For example, if the reduction in the second stand is to be reduced, the reduction in the first stand can be increased.

Figure 5:
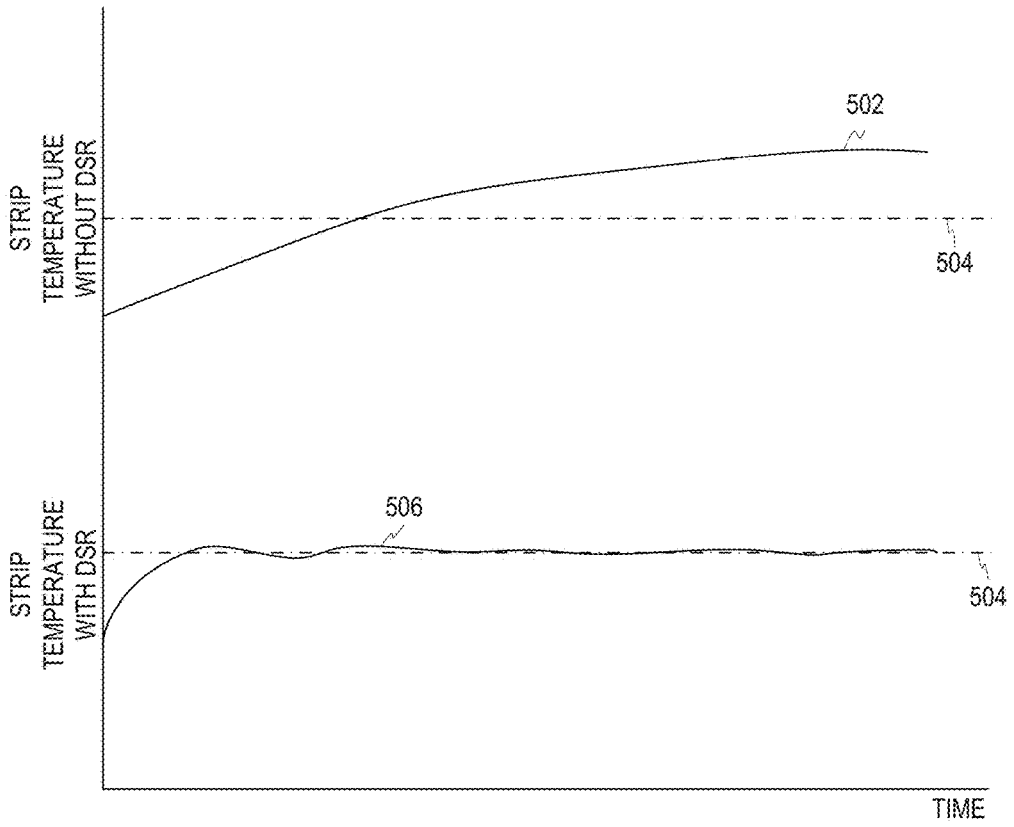
FIG. 5 is a set of graphs depicting strip temperature according to certain aspects of the present disclosure.

FIG. 5 is a set of graphs depicting strip temperature according to certain aspects of the present disclosure. A "Strip Temperature Without DSR" graph depicts a strip temperature 502 compared to a target temperature 504 when the DSR controller is not controlling the reduction of the first stand and second stand. The "Strip Temperature With DSR" graph depicts the strip temperature 506 compared to the target temperature 504 when the DSR controller is controlling the reduction of the first stand, second stand, or both.

As seen in FIG. 5, without DSR control, the strip temperature 502 can take longer to reach the desired target temperature 504 and may exceed the target temperature 504. In contrast, when DSR control is used, the strip temperature 502 can reach the target temperature 504 faster and can maintain an approximate target temperature 504.

Figure 6:
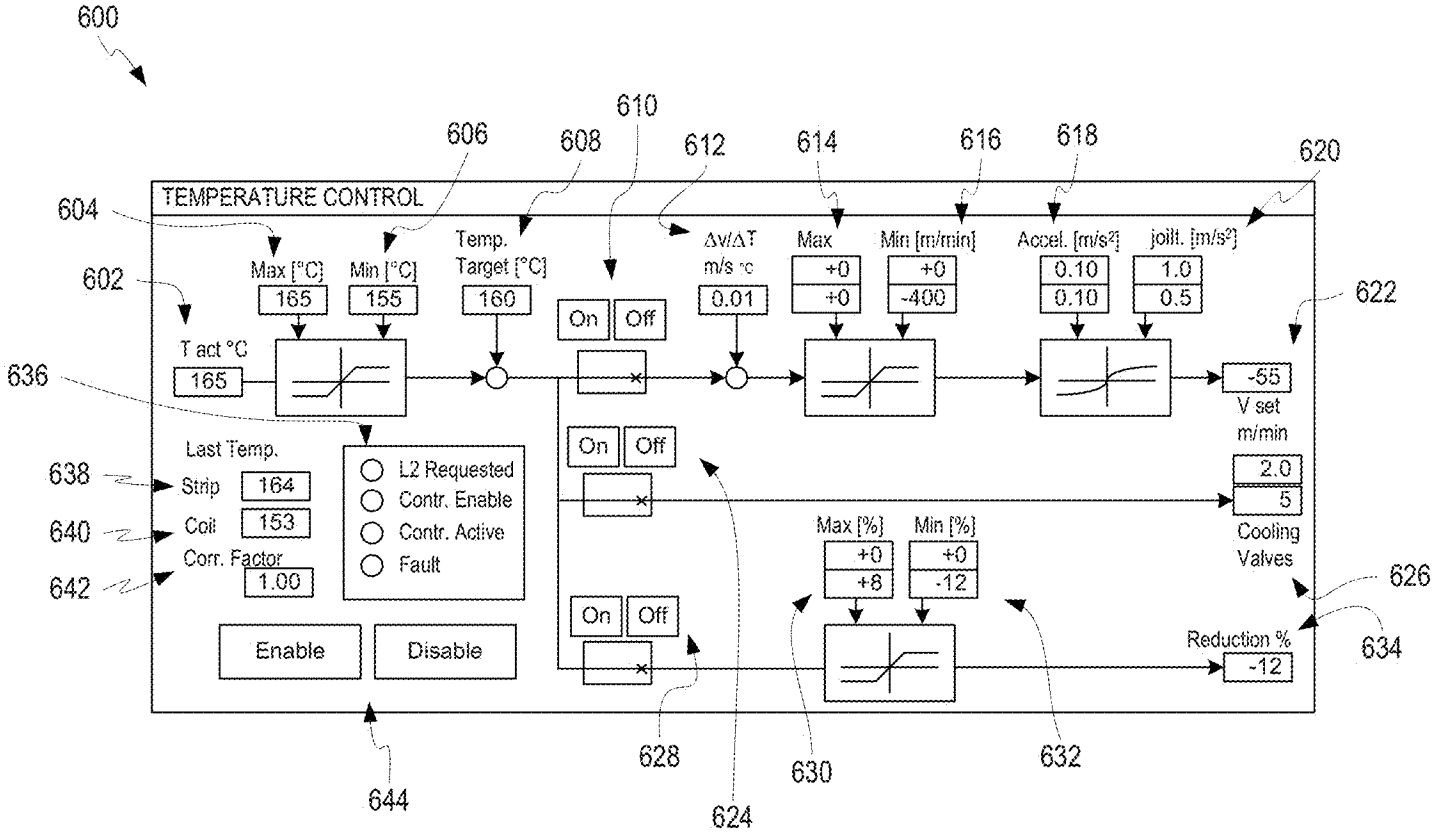
FIG. 6 is a depiction of an interface according to certain aspects of the present disclosure.

FIG. 6 is a depiction of an interface 600 according to certain aspects of the present disclosure. The interface 600 can be used to control a DSR controller, such as the DSR controller 146 of the mill 100 of FIG. 1. The interface 600 illustrates the temperature control loop, speed reduction, strip cooling flow and DSR, showing the minimum and maximum reduction change range.

An actual temperature 602 can be measured by a sensor (e.g., sensor 148) and displayed in the interface 600. A maximum temperature 604 and a minimum temperature 606 can be set. A temperature target 608 can be set or calculated, such as based on the maximum temperature 604 and the minimum temperature 606. Alternatively, a maximum temperature 604 and minimum temperature 606 can be calculated based on the temperature target 608.

Control 610 can be used to enable or disable temperature compensation by adjusting the speed of the strip. The change in speed per change in temperature 612 can be set, including a speed increase setting 614 and a speed decrease setting 616. The speed increase setting 614 can include a maximum and minimum amount that the speed can be increased. The speed decrease setting 616 can include a maximum and minimum amount that the speed can be decreased. Speed ramping controls 618, 620 can be used to set how quickly the change in speed of the strip is effectuated (e.g., amount of acceleration) when the speed of the strip is changed. The speed changing value 622 can be shown.

Control 624 can be used to enable or disable temperature compensation by applying cooling media (e.g., through cooling valves of a fluid sprayer). Control 626 displays the usage of the cooling valves (e.g., a larger number can produce more cooling).

Control 628 can be used to enable or disable temperature compensation by adjusting the amount of reduction the strip undergoes. Positive reduction settings 630 and negative reduction settings 632 can be set. Positive reduction settings 630 can include a minimum and maximum amount of reduction in the positive direction (e.g., more reduction) and negative reduction settings 632 can include a minimum and maximum amount of reduction in the negative direction (e.g., less reduction). Control 634 displays the actual percentage of reduction that is being set by the system.

The interface 600 can include indicators 636 to provide feedback to a user. For example, an "L2 Requested" indicator can mean that another mill system is requesting that the DSR system be used. By further example, a "Contr. Enable" indicator can mean that the temperature control system is enabled (e.g., ready to make adjustments) and a "Contr. Active" indicator can mean that the temperature control system is active (e.g., currently making adjustments). Other indicators can be used.

The last strip temperature 638 and the last coil temperature 640 can be displayed. The last coil temperature 640 can be the temperature of the resultant coil that is wound from the strip 108 after it has been rolled. A correction factor 626 can be displayed. The correction factor 626 can be a factor that can be applied to the strip temperature 638, coil temperature 640, or both to correct for variances.

Controls 644 can be used to enable or disable the temperature control.

Figure 7:
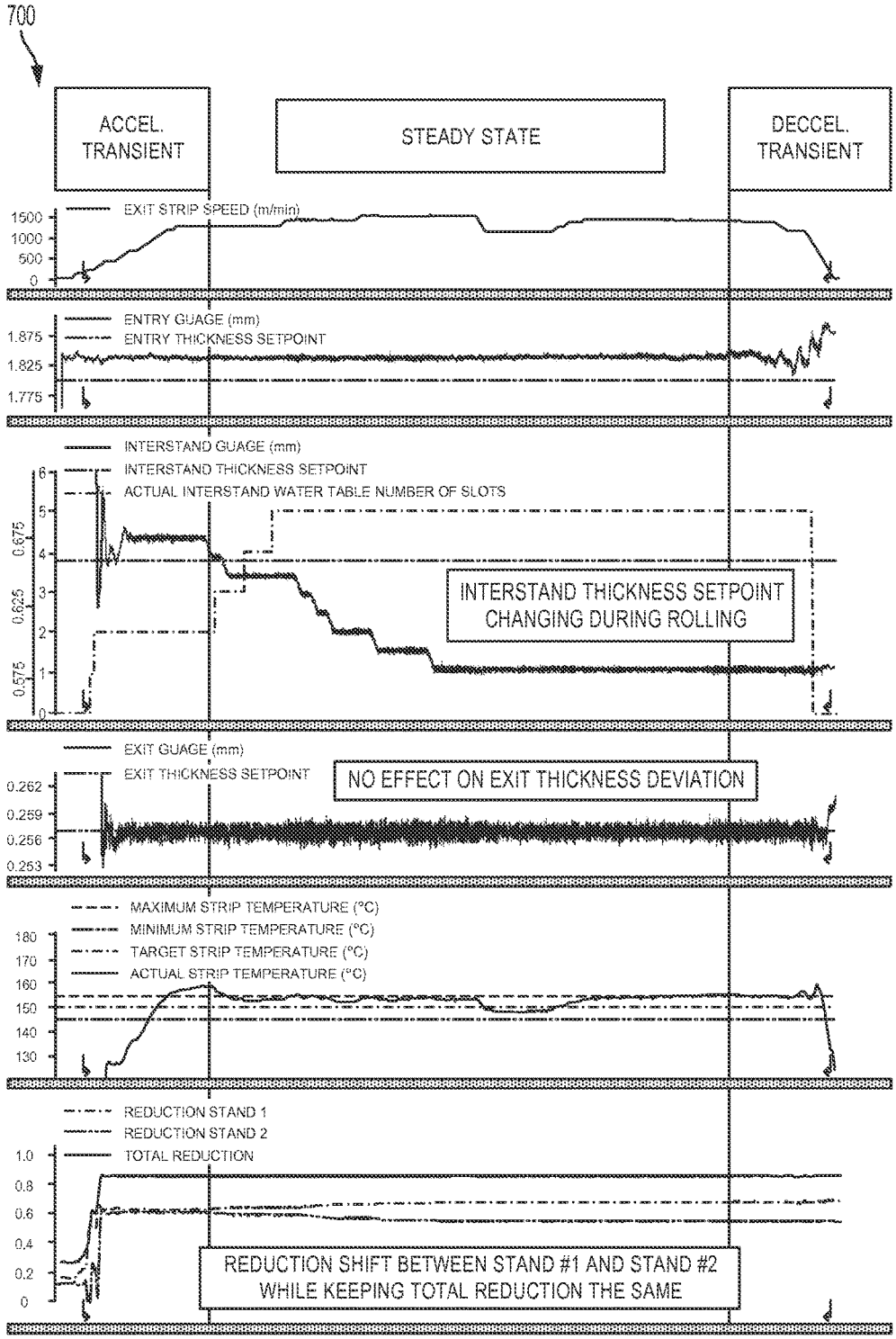
FIG. 7 is an exemplary analysis of data obtained from a coil rolled using an embodiment of the present disclosure.

FIG. 7 illustrates an analysis 700 of data showing the DSR main signals and acceleration and deceleration transients, steady state condition, and general control strategy according to one embodiment.

By reducing or eliminating temperature differences across the material length during the rolling process, the efficiency of downstream processes is improved, which reduces costs. Moreover, the system allows for robust temperature control for any mill unstable condition (for example, when the line speed must drop due to vibration or surface defects). In addition, using the disclosed control system allows for in situ thermal treatment of certain products, which eliminates additional costs to power a furnace and media for inert atmosphere inside the furnace like nitrogen.

By using a control loop as disclosed, the material can reach the desired temperature faster during the acceleration stage and the temperature can be controlled during the steady state and deceleration stages, which delivers a product capable of superior performance. In particular, a rolled material whose temperature is substantially maintained throughout the rolling process has consistent mechanical properties throughout the length of the finished material. In contrast, a rolled material whose temperature fluctuated along its length during rolling often has a first end and a second end having different mechanical properties than the region between the two ends. The mechanical properties of a material where the disclosed DSR controller is used can result in a material that is more robust and that has more uniform mechanical properties over its entire length as compared to a material where a DSR controller is not used.

The disclosed control system may be used in a tandem roll mill of any suitable configuration, including both cold and hot roll mills.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

As used below, any reference to a series of examples is to be understood as a reference to each of those examples disjunctively (e.g., "Examples 1-4" is to be understood as "Examples 1, 2, 3, or 4").

Example 1 is a system, comprising a first stand comprising a first pair of work rolls for reducing a thickness of a material to a first set point; a second stand comprising a second pair of work rolls for reducing the thickness of the material to a second set point; and a controller coupled to a temperature sensor, the first stand, and the second stand for adjusting at least one of the first set point and the second set point based on a temperature of the material as it exits the second stand.

Example 2 is the system of example 1, further comprising a sensor positioned to measure the temperature of the material as it exits the second stand.

Example 3 is the system of examples 1 or 2, further comprising at least a first actuator coupled to the first pair of work rolls for adjusting positioning of the first pair of work rolls; and at least a second actuator coupled to the second pair of work rolls for adjusting positioning of the second pair of work rolls, wherein the controller is coupled to the first actuator and the second actuator for controlling the positioning of the first pair of work rolls and the positioning of the second pair of work rolls based on the temperature of the material as it exits the second stand.

Example 4 is the system of examples 1-3, wherein the controller is configured to increase the second set point to raise the temperature of the material as it exits the second stand and decrease the second set point to lower the temperature of the material as it exits the second stand.

Example 5 is the system of examples 1-4, wherein the controller is configured to keep the temperature of the material as it exits the second stand substantially constant along a length of the material.

Example 6 is the system of examples 1-5, further comprising a heat extraction media system positioned between the first stand and the second stand for providing cooling media to the material.

Example 7 is the system of examples 1-6, wherein the first set point and the second set point are offset from one another, and wherein the control loop adjusts the first set point and the offset.

Example 8 is the system of examples 1-7, further comprising at least one thickness gauge for measuring the thickness of the material between the first stand and the second stand.

Example 9 is a method, comprising: rolling a material to an inter-stand thickness by a first stand; rolling the material to a second thickness by a second stand; measuring an exit temperature of the material as it exits the second stand; and controlling the exit temperature based on the measured exit temperature and a target temperature, wherein controlling the exit temperature includes adjusting the first stand or the second stand.

Example 10 is the method of example 9, wherein controlling the exit temperature includes increasing the inter-stand thickness when the measured exit temperature is below the target temperature; and decreasing the inter-stand thickness when the measured exit temperature is above the target temperature.

Example 11 is the method of examples 9 or 10, wherein controlling the exit temperature includes performing at least one of adjusting a first actuator of the first stand by a first amount based on the measured exit temperature; and adjusting a second actuator of the second stand based on the first amount, wherein the second actuator applies more force to the material when the measured exit temperature is below the target temperature, and wherein the second actuator applies less force to the material when the measured exit temperature is above the target temperature.

Example 12 is the method of examples 9-11, further comprising providing cooling media to the material by a heat extraction media system positioned between the first stand and the second stand.

Example 13 is the method of examples 9-12, further comprising increasing the inter-stand thickness when the mill is in an acceleration transient.

Example 14 is the method of examples 9-13, wherein controlling the exit temperature maintains the temperature of the material substantially constant along a length of the material.

Example 15 is a system, comprising a first actuator for applying a first force to a first set of work rolls of a first stand, wherein the first force from the first actuator is usable to reduce the thickness of a material passing through the first stand by a first amount; a second actuator for applying a second force to a second set of work rolls of a second stand, wherein the second force from the second actuator is usable to reduce the thickness of the material passing through the second stand by a second amount; at least one sensor for measuring an exit temperature of the material as the material exits the second stand; and a controller coupled to the at least one sensor for receiving a measured temperature, wherein the controller is coupled to the first actuator and the second actuator for adjusting the first force applied by the first actuator and the second force applied by the second actuator based on the measured temperature to control the measured temperature.

Example 16 is the system of example 15, wherein the controller includes a memory for storing a target temperature, wherein the controller adjusts the first force applied by the first actuator and the second force applied by the second actuator to keep the measured temperature near the target temperature.

Example 17 is the system of examples 15 or 16, wherein the controller includes a memory for storing a maximum temperature and a minimum temperature, wherein the controller adjusts the first force applied by the first actuator and the second force applied by the second actuator to keep the measured temperature above the minimum temperature and below the maximum temperature.

Example 18 is the system of examples 15-17, wherein the controller is configured to adjust the first force applied by the first actuator to change an inter-stand thickness of the material, and to adjust the second force applied by the second actuator to maintain a post-stand thickness of the material.

Example 19 is the system of examples 15-18, wherein the controller is configured to decrease the exit temperature by increasing the first force applied by the first actuator and decreasing the second force applied by the second actuator.

Example 20 is the system of examples 15-19, wherein the controller is configured to increase the exit temperature by decreasing the first force applied by the first actuator and increasing the second force applied by the second actuator.

What is claimed is:

1. A system, comprising:

a first stand comprising a first pair of work rolls for reducing a thickness of a material to an inter-stand thickness based on an inter-stand thickness set point;

a second stand comprising a second pair of work rolls for reducing the thickness of the material from the inter-stand thickness to an exit thickness based on a second stand set point; and a controller coupled to a temperature sensor, the first stand, and the second stand, wherein the controller is configured to adjust the inter-stand thickness set point and the second stand set point based on a temperature of the material as it exits the second stand, and wherein the first stand and the second stand are adjusted by the controller based on the temperature.

2. The system of claim 1, further comprising:

a sensor positioned to measure the temperature of the material as it exits the second stand.

3. The system of claim 1, further comprising:

at least a first actuator coupled to the first pair of work rolls for adjusting positioning of the first pair of work rolls; and at least a second actuator coupled to the second pair of work rolls for adjusting positioning of the second pair of work rolls, wherein the controller is coupled to the first actuator and the second actuator for controlling the positioning of the first pair of work rolls and the positioning of the second pair of work rolls based on the temperature of the material as it exits the second stand.

4. The system of claim 1, wherein the controller is configured to increase the second stand set point to raise the temperature of the material as it exits the second stand and decrease the second stand set point to lower the temperature of the material as it exits the second stand.

5. The system of claim 1, wherein the controller is configured to keep the temperature of the material as it exits the second stand substantially constant along a length of the material.

6. The system of claim 1, further comprising a heat extraction media system positioned between the first stand and the second stand for providing cooling media to the material.

7. The system of claim 1, further comprising at least one thickness gauge for measuring the thickness of the material between the first stand and the second stand.

8. The system of claim 1, wherein the controller is further configured to maintain the exit thickness while adjusting the at least one of the inter-stand thickness set point and the second stand set point.

9. A method, comprising:

rolling a material to an inter-stand thickness by a first stand;

rolling the material to a second thickness by a second stand;

measuring an exit temperature of the material as it exits the second stand; and controlling the exit temperature based on the measured exit temperature and a target temperature, wherein controlling the exit temperature includes adjusting the first stand and the second stand.

10. The method of claim 9, wherein controlling the exit temperature includes:

increasing the inter-stand thickness when the measured exit temperature is below the target temperature; and decreasing the inter-stand thickness when the measured exit temperature is above the target temperature.

11. The method of claim 9, wherein controlling the exit temperature includes:

adjusting a first actuator of the first stand by a first amount based on the measured exit temperature; and adjusting a second actuator of the second stand based on the first amount, wherein the second actuator applies more force to the material when the measured exit temperature is below the target temperature, and wherein the second actuator applies less force to the material when the measured exit temperature is above the target temperature.

12. The method of claim 9, further comprising providing cooling media to the material by a heat extraction media system positioned between the first stand and the second stand.

13. The method of claim 9, further comprising increasing the inter-stand thickness during an acceleration transient as the material accelerates to a target speed.

14. The method of claim 9, wherein controlling the exit temperature maintains the temperature of the material substantially constant along a length of the material.

15. The method of claim 9, wherein controlling the exit temperature includes maintaining the second thickness.

16. A system, comprising:

a first actuator for applying a first force to a first set of work rolls of a first stand, wherein the first force from the first actuator is usable to reduce the thickness of a material passing through the first stand by a first amount;

a second actuator for applying a second force to a second set of work rolls of a second stand, wherein the second force from the second actuator is usable to reduce the thickness of the material passing through the second stand by a second amount;

at least one sensor for measuring an exit temperature of the material as the material exits the second stand; and a controller coupled to the at least one sensor for receiving a measured temperature, wherein the controller is coupled to the first actuator and the second actuator for adjusting the first force applied by the first actuator and the second force applied by the second actuator based on the measured temperature to control the measured temperature, wherein the controller is configured to adjust the first force applied by the first actuator to change an inter-stand thickness of the material, and to adjust the second force applied by the second actuator to maintain a post-stand thickness of the material.

17. The system of claim 16, wherein the controller includes a memory for storing a target temperature, wherein the controller adjusts the first force applied by the first actuator and the second force applied by the second actuator to keep the measured temperature near the target temperature.

18. The system of claim 16, wherein the controller includes a memory for storing a maximum temperature and a minimum temperature, wherein the controller adjusts the first force applied by the first actuator and the second force applied by the second actuator to keep the measured temperature above the minimum temperature and below the maximum temperature.

19. The system of claim 16, wherein the controller is configured to decrease the exit temperature by increasing the first force applied by the first actuator and decreasing the second force applied by the second actuator.

20. The system of claim 16, wherein the controller is configured to increase the exit temperature by decreasing the first force applied by the first actuator and increasing the second force applied by the second actuator.

* * * * *